United States Patent [19]

Kobayashi et al.

[11] Patent Number: 4,934,914

[45] Date of Patent: Jun. 19, 1990

[54] PORTABLE MOTOR PUMP

[75] Inventors: Makoto Kobayashi, Kawasaki; Kiyoshi Ouchi, Fujisawa; Shinji Nishimori, Yokohama; Tsuyoshi Maeda, Fujisawa; Yoshio Miyake, Yokohama, all of Japan

[73] Assignee: Ebara Corporation, Tokyo, Japan

[21] Appl. No.: 226,209

[22] Filed: Jul. 29, 1988

[30] Foreign Application Priority Data

| | | | |
|---|---|---|---|
| Jul. 30, 1987 | [JP] | Japan | 62-115845[U] |
| Sep. 24, 1987 | [JP] | Japan | 62-144343[U] |
| Oct. 13, 1987 | [JP] | Japan | 62-155642[U] |

[51] Int. Cl.[5] ..... F04B 39/00

[52] U.S. Cl. ..... 417/423.3; 417/423.14; 417/434; 417/435; 415/56.5; 222/382; 137/533.11

[58] Field of Search ..... 417/423.3, 423.9, 423.14, 417/424.1, 430, 434, 435, 360, 900, 234; 415/206, 224, 226, 56.2, 56.5, 121.1; 137/533.11, 590; 222/377, 382

[56] References Cited

U.S. PATENT DOCUMENTS

| | | | |
|---|---|---|---|
| 1,605,758 | 11/1926 | Moussette | 222/382 |
| 3,270,678 | 9/1966 | Monica | 415/206 |
| 3,443,519 | 5/1969 | White | 417/423.8 X |
| 3,637,331 | 1/1972 | Smith et al. | 417/423.9 |
| 3,945,771 | 3/1976 | Arakawa . | |
| 4,309,155 | 1/1982 | Heinz et al. | 417/435 X |
| 4,523,899 | 6/1985 | Ouchi . | |
| 4,588,353 | 5/1986 | Shibata et al. | 415/121.1 |
| 4,650,342 | 3/1987 | Goodwin | 415/121.1 X |

FOREIGN PATENT DOCUMENTS

| | | | |
|---|---|---|---|
| 51-34008 | 8/1976 | Japan . | |
| 56-53111 | 12/1981 | Japan . | |
| 57-114197 | 7/1982 | Japan . | |
| 57-114198 | 7/1982 | Japan . | |
| 57-200698 | 12/1982 | Japan | 417/435 |
| 59-110896 | 6/1984 | Japan . | |
| 59-147900 | 8/1984 | Japan . | |
| 60-216094 | 10/1985 | Japan | 415/156 |

*Primary Examiner*—Leonard E. Smith
*Assistant Examiner*—Eugene L. Szczecina, Jr.
*Attorney, Agent, or Firm*—Oblon, Spivak, McClelland, Maier & Neustadt

[57] ABSTRACT

A portable motor pump of the type in which a pump section driven by a motor is installed inside a liquid chamber, with a discharge port of the pump section being opened into the liquid chamber, and in which water which is to be pumped is led from the outside of the liquid chamber to a suction port of the pump section and the pumped water is discharged from the liquid chamber to the outside is disclosed. The liquid chamber is defined by a motor pump body, a pump outer casing outwardly spaced from and surrounding the motor pump body, a motor head cover covering an upper opening of the pump outer casing and a bottom plate covering a lower opening of the pump outer casing. A circulating water suction port for self-priming of the motor pump is opened into the liquid chamber. A suction port which communicates with the suction port of the pump section and a discharge port for discharging the pumped water to the outside are provided in the motor head cover.

30 Claims, 6 Drawing Sheets

PORTABLE MOTOR PUMP

BACKGROUND OF THE INVENTION:

1. Field of the Art

The present invention relates to a motor pump used to drain residual water the level of which is relatively low. More particularly, the present invention pertains to an internal motor pump which is arranged such that a motor pump body is surrounded with a pump outer casing to define a space therebetween and pumped water is discharged to the outside through the space to thereby cool the motor.

2. Prior Art

A so-called external motor pump has heretofore been known in which a submerged motor pump is installed under water in a cistern. In this motor pump, a discharge port of the motor pump is opened into the cistern, and water which is to be pumped is led from the outside of the cistern to a suction port of the pump through a suction conduit and pumped water is discharged to the outside from a discharge port provided at the upper portion of the cistern. There is another prior art which is arranged such that wheels are attached to the bottom of the above-described external motor pump so that it is mobile (portable); a flexible suction conduit having its open end defined as a suction port is employed so that the suction conduit can be inserted into any liquid source; and a self-priming function is imparted to the pump in order to prevent pumping failure due to air lock in the case where the water level of the liquid source is relatively low. An air lock would otherwise be caused by air sucked in from the open end of the suction conduit together with the liquid as the liquid source is nearly drained. Such a portable external motor pump is, for example, disclosed in Japanese Utility Model Publication No. 53111/81.

Since the above-described external motor pump is mobile and has a self-priming function, it is possible to drain a liquid source, for example, a puddle in a public works site, with substantially no residual water being left.

However, since the above-described known motor pump is formed as an external motor pump in which a submerged motor pump is installed under water in a relatively large-sized cistern, and heavy wheels are attached in order to support the cistern, the overall dimensions and weight of the apparatus are considerably increased. Accordingly, a disadvantageously large amount of priming is needed for a self-priming operation at the time of starting the pump.

It has also heretofore been the practice to employ an internal motor pump arranged such that a motor pump body is surrounded with a pump outer casing to define a space therebetween and pumped water is discharged to the outside through the space while cooling the motor. Such an internal motor pump is, for example, shown in U.S. Pat. No. 3945771. In this prior art, however, since the space between the pump outer casing and the motor pump body is utilized only as a pump discharge passage serving as a motor cooling water passage, it has no self-priming function and, therefore, cannot drain residual water the level of which is relatively low.

Therefore, the object of the present invention is to provide a portable motor pump which is so designed that it is possible to drain residual water the level of which is relatively low and having an overall size and weight that are reduced to make it easy to carry.

SUMMARY OF THE INVENTION:

To solve the above-described problems of the prior art and to accomplish to objects stated above, the present invention provides a portable motor pump wherein a pump section driven by a motor is installed inside a liquid chamber, with a discharge port of said pump section being opened into said liquid chamber, and water which is to be pumped is led from the outside of said liquid chamber to a suction port of said pump section and said pumped water is discharged from said liquid chamber to the outside, said liquid chamber being defined by a motor pump body, a pump outer casing outwardly spaced from and surrounding said motor pump body, a motor head cover covering an upper opening of said pump outer casing and a bottom plate covering a lower opening of said pump outer casing, a circulating water suction port for self-priming of said motor pump is opened into the liquid chamber, and a suction port communicated with said suction port of said pump section and a discharge port for discharging the pumped water to the outside are provided in said motor head cover.

The function of the present invention arranged as described above is as follows. At the time of initiating the operation of the pump, priming required for the self-priming operation is first supplied to the inside of the pump outer casing. The priming is stored in the liquid chamber defined between the pump outer casing and the motor pump body. When, in this state, the pump is started, priming is sucked into the pump section, that is, the pump chamber, through the self-priming circulating water suction port opened into the liquid chamber. In this suction process, priming is pressurized by an impeller together with air sucked in through the suction port of the pump section, and the pressurized mixture of air and water is discharged from the discharge port of the pump chamber into the liquid chamber inside the pump outer casing. The discharged air-water mixture is separated into air and water inside the pump outer casing. The air is discharged to the outside from the discharge port provided in the motor head cover, and the liquid alone is sucked in again from the circulating water suction port. In this way, a circulating flow is created and thus a self-priming action, i.e., a vacuum pumping action, takes place.

Negative pressure is produced in the suction port of the motor head cover connected to the pump section suction port to suck air from a suction conduit connected to the suction port of the motor head cover. As the suction-side air is gradually expelled in this way, liquid is sucked in from the distal end of the suction conduit, and the sucked liquid joins the above-described circulating flow inside the pump chamber and is pressurized by the impeller and discharged into the liquid chamber inside the pump outer casing. When the liquid chamber is filled up with the liquid discharged from the pump chamber, the liquid starts to be discharged from the discharged port provided in the motor head cover to a predetermined place. Thus, the self-priming operation is completed.

After the self-priming operation has been switched to a normal pump operation, the pump functions as an ordinary motor pump, so that the liquid sucked in from the suction port provided in the motor head cover is pressurized by the impeller and discharged from the discharge portion to a predetermined place. When the water level on the suction side lowers to such a level that air is sucked in from the suction port, the above-described self-priming operation is appropriately carried out, and the pump operation is thus continued without being interrupted by air lock. Accordingly, almost all the liquid can be drained with substantially no residual water being left.

The above-described pump outer casing, which is equivalent to the pump outer casing in the conventional internal pump, is disposed below the motor head cover and has a relatively small volume. However, it is possible to effectively perform both a self-priming operation and a motor cooling operation which utilize a circulating flow created inside the outer casing.

In a motor pump of this invention as stated above, it is possible to store water to the level of the inner upper end of the pump outer casing and also reduce the diameter of the pump outer casing. Therefore, it is possible to reduce the overall size and weight of the motor pump. Thus, it is possible to obtain a compact and portable motor pump. In addition, the interior of the pump can be readily inspected by removing the motor head cover or the bottom plate.

Since the liquid storage portion is smaller than in the case of the conventional exterior pumps, the amount of priming required to effect a self-priming operation is relatively small, so that it is possible to readily drain residual water the level of which is relatively low.

Many other advantages, features and additional objects of the present invention will become apparent to persons skilled in the art upon making reference to the detailed description and the accompanying drawings in which preferred embodiments of the present invention are shown by way of illustrative example.

PREFERRED EMBODIMENT OF THE INVENTION:

Embodiments of the present invention will be described hereinunder with reference to the drawings.

Figure 1:
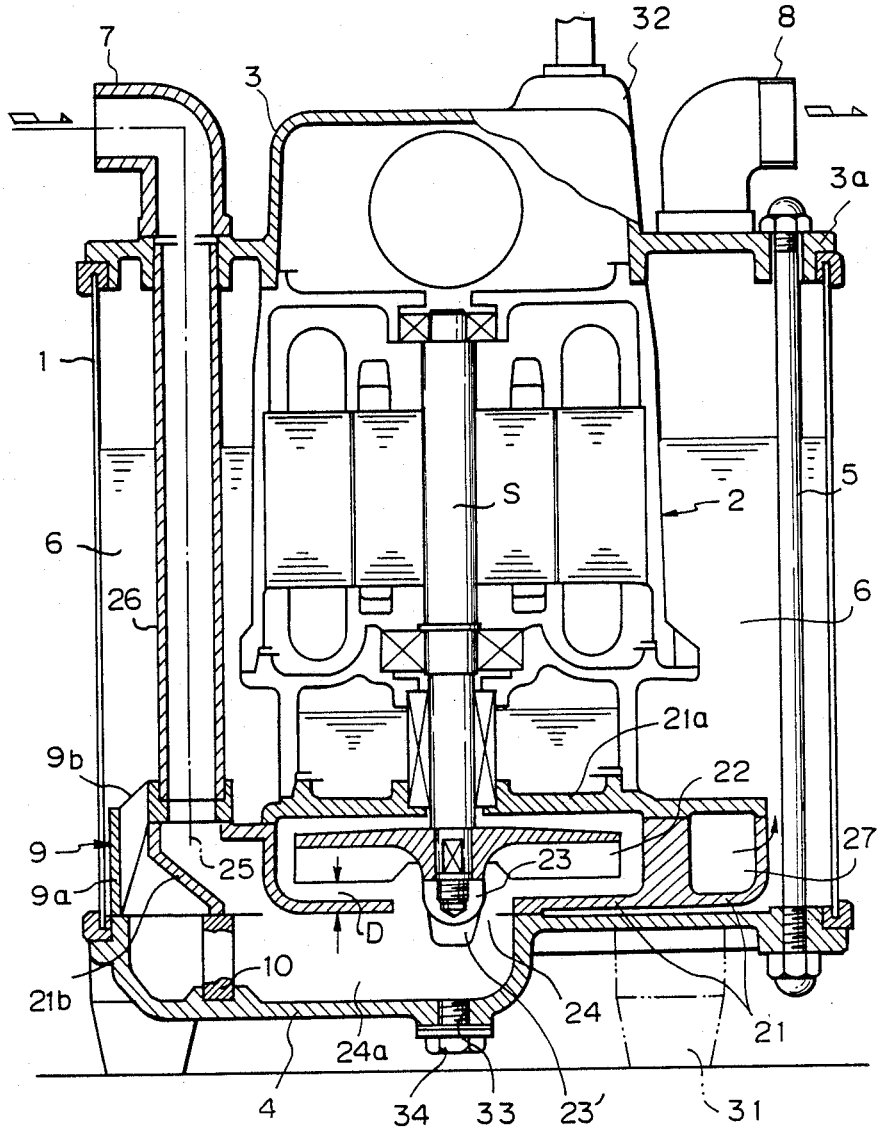
FIG. 1 is a vertical sectional view taken along the line I—I of FIG. 2, which shows one embodiment of the motor pump according to the present invention.
Figure 2:
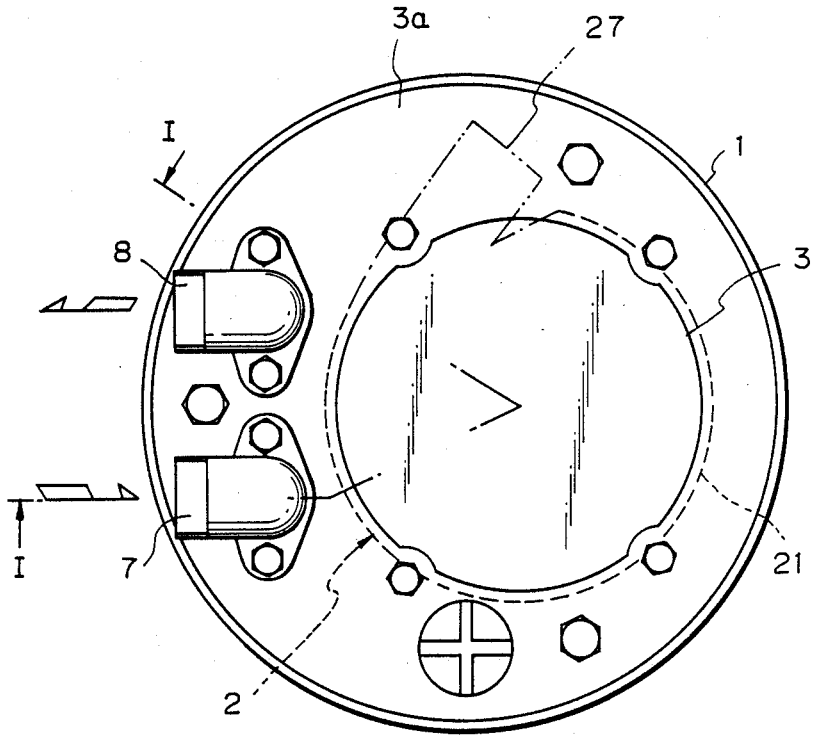
FIG. 2 is a plan view of the embodiment.

FIG. 1 is a vertical sectional view taken along with line I—I of FIG. 2, which shows one embodiment of the motor pump according to the present invention, while FIG. 2 is a plan view of the embodiment.

Referring to these figures, a motor pump body 2 is eccentrically disposed inside a cylindrical pump outer casing 1, as shown in FIG. 2. The upper opening of the pump outer casing 1 is closed with a motor head cover 3 having an extended peripheral portion 3*a*, while the bottom of the outer casing 1 is closed with a bottom plate 4. The motor head cover 3 and the bottom plate 4 are fastened to each other by means of through-bolts 5 with the pump outer casing 1 sandwiched therebetween. Thus, an eccentric, annular liquid chamber 6 which is defined between the pump outer casing 1 and the motor pump body 2 is maintained in a hermetically sealed state.

A suction port 7 and a discharge port 8 are provided in close proximity with each other in that portion of the peripheral portion 3*a* of the motor head cover 3 which has the greatest width, that is, where the outer periphery of the motor pump body 2 is most remote from the inner periphery of the pump outer casing 1 (i.e., the left-hand portion as viewed in FIG. 2). In actual use, a flexible suction conduit (not shown) and a discharge pipe (not shown) are connected to the suction port 7 and the discharge port 8, respectively.

A pump section is disposed at the lower end of the motor pump body 2. The pump section is arranged such that an impeller 22 is disposed within a pump casing 21 closer to the upper wall (as viewed in FIG. 1) 21*a* of the casing 21 so as to define a relatively large clearance D at the front of the impeller 22, thereby enabling foreign matter such as sand to be carried out together with a vortex flow generated in the space defined by the clearance D, and thus minimizing wear of the impeller 22. In other words, the pump section constitutes a vortex pump. An air lock preventing nut 23 is mounted on the distal end of a shafts of the impeller 22. The nut 23 includes wings 23' on its distal end for stirring water flow near the impeller 22 and thereby mixing air and water in the flow.

The pump casing 21 has a pump chamber suction port 24 defined by an annular clearance. The pump chamber suction port 24 communicates with a pump casing suction port 25 which corresponds to a pump section suction port through a suction passage 24*a*. The pump casing suction port 25 communicates with the above-described suction port 7 through a flexible or non-flexible hose 26. As shown in FIG. 1, the suction passage 24*a* is defined between an upper surface of the bottom plate 4 and a lower surface of a casing portion of the pump casing 21. To this end, a suitable channel is integrally formed in the bottom plate 4 by casting and it forms the suction passage 24*a* in cooperation with the lower portion of the pump casing 21.

In the vicinity of the pump casing suction port 25 is disposed a circulating water suction pipe section 9*a* extending upward and having at its upper end a circulating water suction port 9*b*. The pipe section 9*a* forms a complete circulating water suction pipe 9 in cooperation with a lower casing portion 21*b* of the pump casing 21. The pipe section 9*a* also supports the lower end of the hose 26. A nozzle 10 is disposed within a recess formed in the bottom plate 4 and communicates with an outlet of the circulating water suction pipe 9 and is open to the suction passage 24*a*.

A pump chamber discharge port 27 which corresponds to a pump section discharge port opens into the eccentric, annular liquid chamber 6, that is, a discharge chamber defined inside the pump outer casing 1. It should be noted that the discharge port 27 is positioned near an area which is diametrically opposite to the afore-mentioned self-priming circulating water suction port 9b to obtain a long flow path between the discharge port 27 and the suction port 9b. The reference numerals 31 and 32 in FIG. 1 denote a resilient leg portion and a cable lead-out portion, respectively. Incidentally, a water drip hole 33 is provided in the bottom plate 4 and is sealed by a plug 34.

The operation of the above-described embodiment will next be explained. At the time of initiating the operation of the pump, priming required for self-priming operation is first supplied to the inside of the pump outer casing 1. The priming is stored in the liquid chamber (discharge chamber) 6 defined between the pump outer casing 1 and the motor pump body 2. When, in this state, the pump is started, priming is sucked into the pump casing 21 through the self-priming circulating water suction port 9b opened into the liquid chamber 6. In this process, the liquid sucked in from the circulating water suction port 9b causes a negative pressure to be produced at the outlet of the nozzle 10 by an ejector action of the liquid jetting out of the nozzle 10 into the suction passage 24a. As a result, air and liquid in a suction conduit (not shown) connected to the suction port 7 is sucked in through the suction port 7.

The air and liquid sucked in from the suction side and the liquid sucked in from the circulating water suction port 9b are mixed together, and the resulting mixture is pressurized by the impeller 22 within the pump chamber and discharged into the liquid chamber (discharge chamber) 6 from the pump chamber discharge port 27. The discharged mixture of air and water is separated in the liquid chamber 6. In this case, since the discharge port 27 is positioned far from the circulating water suction port 9b, the flow path of the mixture between the ports 27 and 9b is long and, therefore, separation efficiency is improved. The air separated from the liquid is discharged to the outside from the discharge port 8, and the liquid alone is sucked in again from the circulating water suction port 9b. In this way, a circulating flow is created and thus a self-priming operation is carried out.

As the suction-side air is gradually evacuated by the above-described self-priming operation, liquid is sucked in from the distal end of the suction conduit (not shown) through the suction port 7 provided in the motor head cover peripheral portion 3a. The sucked liquid joins the above-described circulating flow inside the pump chamber and is pressurized by the impeller 22 and discharged into the liquid chamber 6. When the liquid chamber 6 is filled up with the liquid discharged from the pump chamber, the liquid starts to be discharged from the discharge port 8 provided in the peripheral portion 3a of the motor head cover 3. Thus, the self-priming operation is completed.

After the self-priming operation has been switched to a normal pump operation, the pump functions as an ordinary motor pump, so that the liquid sucked in from the suction port 7 is pressurized by the impeller 22 and discharged from the discharge portion 8 to a predetermined place. Even if foreign matter, for example, sand, is sucked in from distal end of the suction conduit (not shown) during the normal pump operation, since the pump section is formed so as to function as a vortex pump, the foreign matter is carried by a vortex flow generated in the space at the front side of the impeller 22 and thereby discharged from the pump chamber discharge port 27. Accordingly, the wear of the impeller 22 is minimized.

Even if the sand discharged from the pump chamber discharge port 27 is deposited within the liquid chamber 6 defined inside the pump outer casing 1, there is no fear of the pump chamber discharge port 27 being closed with sand because pressurized water jets out from the discharge port 27. On the other hand, the circulating water suction port 9b is disposed at a level higher than the main plate of the impeller 22 and there is therefore no fear of sand being sucked in through the suction port 9b.

Since the motor pump body 2 is eccentrically disposed inside the pump outer casing 1, the flow of fluid that is discharged from the pump chamber discharge port 27 becomes irregular and turbulent in the process of flowing through the eccentric, annular liquid chamber 6 to reach the discharge port 8 or the circulating water suction port 9b. Accordingly, the amount of earth and sand deposited on the bottom is reduced correspondingly.

When the water level on the suction side lowers to such a level that air is sucked in from the suction port 7, the above-described self-priming operation is conducted again, and the pump operation is thus continued without being interrupted by air lock. Accordingly, almost all of residual water is effectively sucked. Meanwhile, the liquid stored in the liquid chamber 6 functions not only as priming for the self-priming operation but also as cooling water for cooling the motor.

This embodiment provides the following advantages:

(i) The peripheral wall of the cistern of this type of conventional motor pump is defined by the pump outer casing 1 of an internal motor pump, thereby forming the whole of the motor pump into a kind of internal motor pump, and the pump outer casing 1 is closed at both ends with the motor head cover 3 and the bottom plate 4, respectively, in such a manner that the cover 3 and the bottom plate 4 are fastened to each other with the pump outer casing 1 sandwiched therebetween by means of through bolts 5. Accordingly, it is possible to reduce the overall size and weight of the pump and facilitate the transportation and disassembly as well as inspection. It is also possible to reduce the amount of priming required for self-priming operation. Since the motor head cover 3 is opened to the atmosphere, it is unnecessary to seal the motor cable lead-out portion so that there is no leakage of water as in the case of the external motor pump, and it is possible to attach a carrying handle directly to the motor head cover.

(ii) Since the motor pump body 2 is eccentrically disposed inside the pump outer casing 1, the flow of fluid that is discharged from the pump chamber discharge port 27 becomes irregular and turbulent in the process of flowing through the eccentric, annular liquid chamber 6 to reach the discharge port 8 or the circulating water suction port 9b. Accordingly, the amount of earth and sand deposited on the bottom is reduced correspondingly.

(iii) Since the suction passage 24a is defined between the upper surface of the bottom plate 4 and the lower surface of the pump casing 21, it is easy to inspect and clean the suction passage by removing the bottom plate 4. Moreover, if the pump casing portion and the bottom plate 4 forming the suction passage 24a are to be made by casting, since a core is not necessary for casting, they can be made economically.

(iv) Since the water drip hole 33 is provided in the bottom plate 4 and is sealed by the plug 34, it is easy to drain earth and sand deposited within the pump casing during pump operation.

(v) Since the self-priming circulating water suction port 9b is positioned near an area which is diametrically opposite to the pump section discharge port 27, the water flow path from the suction port 9b to the discharge port 27 is long, and therefore, the separation of water and air during the water flow is increased resulting in improvement of self-priming operation efficiency.

(vi) Since the nozzle 10 is provided at the outlet of the self-priming circulating water from the circulating water suction pipe 9, it causes ejector action in the outlet of the nozzle 10 due to water flow passing therethrough. The suction of air and water from the suction port 25 into the suction passage 24a is thereby increased and it leads to improvement of the self-priming operation efficiency.

(vii) Since the air lock nut 23 including wings 23' is provided at the end of impeller shaft, it stirs and mixes water and air flow around the pump chamber suction port 24 to prevent air lock and, therefore, results in improvement of the self-priming operation efficiency.

Figure 3:
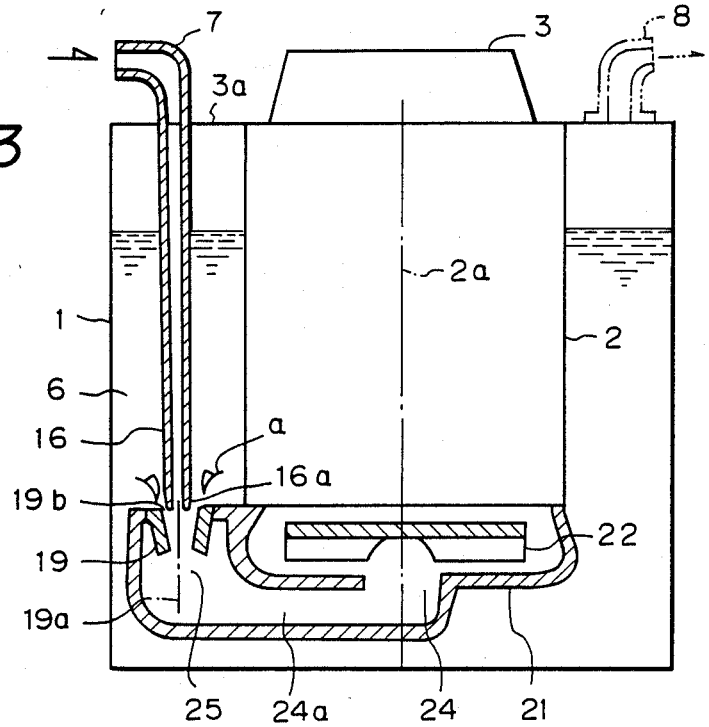
FIG. 3 is a sectional view of another embodiment of the present invention.

FIG. 3 is a sectional view of another embodiment of the present invention, in which the same reference numerals as those in FIG. 1 denote the same or like elements or portions.

In this embodiment, a nozzle 19 is provided at the pump section suction port 25 such that the axis 19a of the nozzle 19 is parallel to the axis 2a of the motor pump body 2. The inlet portion of the nozzle 19 is connected to the suction port 7 provided in the peripheral portion 3a of the motor head cover 3 through a conduit 16. The conduit 16 extends substantially parallel to the axis 2a of the motor pump body 2. A circulating water suction port is defined by an annular clearance 19b which is provided between the outer periphery of the lower end portion 16a of the conduit 16 and the inner periphery of the nozzle 19. Also, in this embodiment, the suction passage 24a is formed by the pump casing 21.

According to this embodiment, during self-priming operation, circulating water is sucked into the suction passage 24a through the nozzle 19 while passing through the annular clearance 19b, as shown by the arrow a. The flow of sucked water causes a negative pressure to be produced in the vicinity of the end portion 16a of the conduit 16 by the ejector action, and the air at the suction side is sucked in from the suction port 7 by the action of the negative pressure in the same way as in the first embodiment (shown in FIG. 1). In this embodiment, however, it is unnecessary to provide a circulating water suction pipe as in the case of the first embodiment. Therefore, the space required to install the nozzle is reduced, which results in a compact apparatus. It should be noted that, if the conduit 16 is flexible, there will be no problem even if the nozzle 19 and the suction port 7 are slightly offset from each other.

Figure 4:
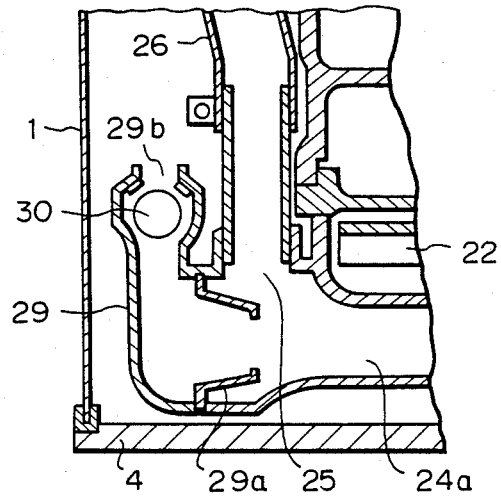
FIG. 4 is a fragmentary sectional view of still another embodiment of the present invention.

FIG. 4 is a fragmentary sectional view of still another embodiment of the present invention, in which the same reference numerals as those in FIG. 1 denote the same or like elements or portions.

In this embodiment, a ball type check valve 30 is provided in the suction port 29b at the upper end of the circulating water suction pipe 29. The reference numeral 29a in the figure denotes a nozzle which is provided as a separate member.

The check valve 30 is formed using buoyant material so that, when the flow rate of circulating water is relatively low, for example, during self-priming operation, the valve 30 is not in contact with the valve seat provided at the bottom of the valve chamber but sufficiently buoyant to pass the circulating flow (FIG. 4 shows this state). After the self-priming operation has been switched to a normal pump operation, the pressure difference between the suction and discharge sides of the pump chamber is increased and the flow rate of circulating water is increased correspondingly. Therefore, the check valve 30 is pressed downward and kept in contact with the valve seat.

Thus, since the circulating flow is blocked during a normal pump operation, the pump performance is enhanced. In addition, there is no fear of sand deposited inside the pump outer casing 1 entering the pump chamber through the circulating water suction port 29b and it is therefore possible to prevent the wear of the interior of the pump chamber during a normal pump operation.

Figure 5:
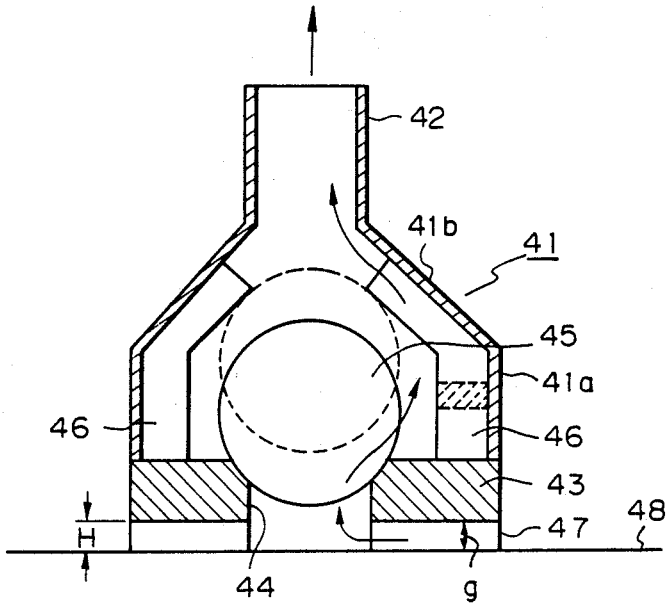
FIG. 5 is a vertical sectional view of one embodiment of the suction check valve which is suitable for use in the motor pump according to the present invention.
Figure 6:
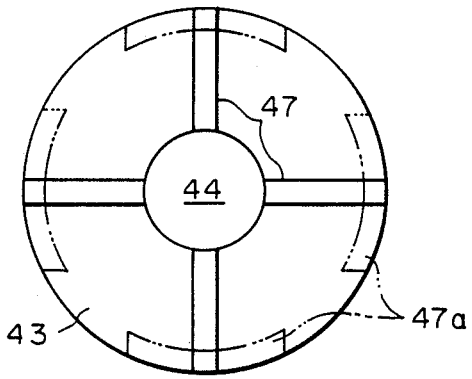
FIG. 6 is a bottom view of the suction check valve of FIG. 5.

FIG. 5 is a vertical sectional view of one embodiment of a suction check valve which is suitable for use in the motor pump according to the present invention.

Referring to FIG. 5, a valve body 41 has a cylindrical portion 41a, a conical portion 41b provided on the upper side of the cylindrical portion 41a, an outlet 42 provided at the top portion and is connected to the suction port 7 of the motor pump through a suction conduit (not shown), a bottom plate 43 serving as a valve seat having a valve opening 44 in its center, and a ball-shaped valve member 45 vertically movably placed on the bottom plate 43 so as to open and close the valve opening 44. The bottom plate 43 and the ball-shaped valve member 45 are made of respective resilient materials. Ribs (projections) 46 having a square cross-section are provided such as to extend along the inner surfaces of the cylindrical and conical portions 41a and 41b of the valve body 41 for the purpose of guiding (limiting) the movement of the ball-shaped valve member 45 and of defining liquid passages. A plurality of circumferentially spaced projections 47 having a predetermined height H are provided on the lower surface of the bottom plate 43. The gap g between the lower surface of the bottom plate 43 and the floor surface 48 which are spaced apart from each other by the projections 47 defines a suction passage of liquid.

The outlet 42 at the top of the valve body 41 is connected to the distal end of a suction conduit of a pump (not shown) as stated above, while the bottom plate 43 is placed on the floor surface 48, and the pump is started to suck liquid on the floor surface 48. In consequence, the ball-shaped valve member 45 rises to the chain-line position shown in FIG. 5 to open the valve opening 44. As a result, the liquid on the floor surface 48 is sucked into the valve chamber through the valve opening 44 as shown by the arrow while passing through the gap g defined by the projections 47. The liquid thus sucked advances through the space defined between each pair of adjacent ribs 46 as shown by the arrow and is eventually sucked into the suction conduit of the pump (not shown) from the outlet 42.

The level of water on the floor surface 48 lowers as the above-described sucking operation continues, but no air is sucked in and the draining operation is continued as long as the level of water on the floor surface 48 is above the height H which corresponds to the gap g between the lower surface of the bottom plate 43 and the floor surface 48. Accordingly, if the value for H of the gap g is minimized, it is possible to drain almost all the liquid. The gap g also functions as a strainer.

This suction check valve provides the following advantages:

(i) The bottom plate 43 of the valve body 41 also serves as a valve seat and therefore enables a reduction in the number of required parts, so that it is possible to produce the suction check valve at a reduced cost.

(ii) Since the valve member 45 is formed in the shape of a ball, fibrous substances are unlikely to coil around the valve member 45.

(iii) When the check valve is used on the floor surface 48, a strainer function is performed at the gap g defined by the projections 47 between the bottom plate 43 and the floor surface 48.

(iv) Since both the bottom plate 43 and the ball-shaped valve member 45 are formed using resilient materials, the sealing effect is enhanced.

Figure 7:
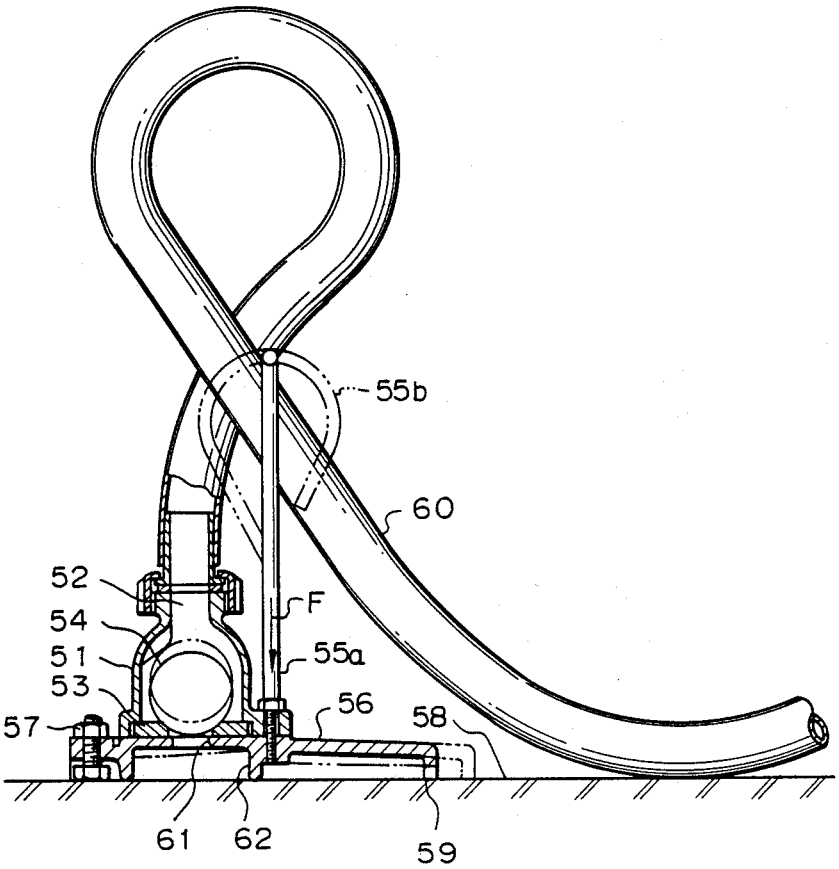
FIG. 7 is a vertical sectional view of another embodiment of the suction check valve which is suitable for use in the motor pump of the present invention, which shows the check valve connected to an end of a flexible suction conduit.
Figure 8:
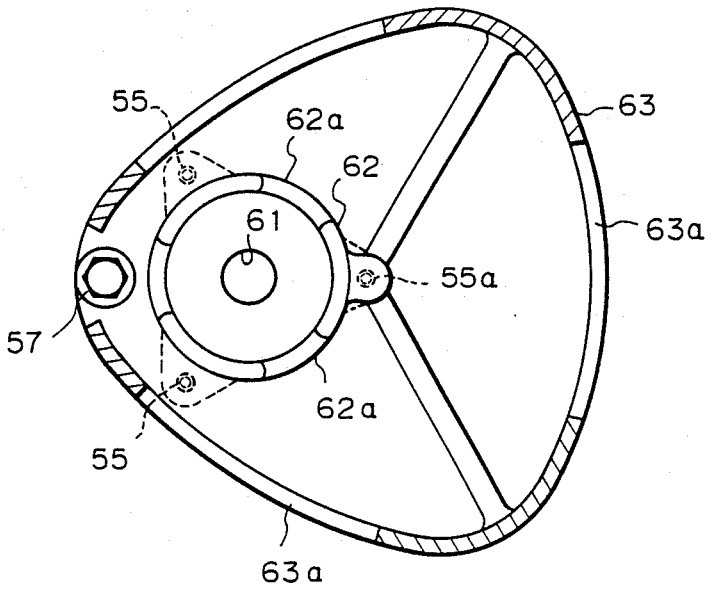
FIG. 8 is a bottom view of the suction check valve shown in FIG. 7.

FIG. 7 is a vertical sectional view of another embodiment of the suction check valve which is suitable for use in the motor pump according to the present invention, which shows the check valve connected to the end of a flexible suction conduit, while FIG. 8 is a bottom view of the suction check valve.

Referring to these figures, a bell-shaped valve body 51 has at its top an outlet 52 which is connected to the end portion of a flexible suction conduit 60. The other end of the conduit 60 is connected to the suction port 7 of the motor pump. The valve body 51 accommodates therein a ball-shaped valve member 54 resting on a valve seat 53. The lower end of the valve body 51 is eccentrically secured to a bottom plate 56, that is, the valve body 51 is disposed at a position which is sideways (leftward as viewed in the figures) offset from the center of the bottom plate 56.

The bottom plate 56 is provided with a suction opening 61 which faces the opening in the valve seat 53 of the valve body 51. A circumferential rib 62 having liquid passing openings **62*a* is provided on the lower surface of the bottom plate 56 so as to surround the suction opening 61, and a peripheral rib 63 having liquid passing openings 63*a* is provided along the peripheral portion of the bottom plate 56**.

The valve body 51 is secured to the bottom plate 56 by a plurality of mounting bolts 55. Among them, the mounting bolt **55*a* which is closer to the center of the bottom plate 56 is extended upward, and the upper end portion is bent in the shape of a ring to define a ring-shaped portion 55*b*. It should be noted that the reference numeral 57 in the figures denotes a bolt used to adjust the horizontal angle of the bottom plate 56, while the numeral 58** denotes the floor surface.

In actual use, the above-described suction check valve is connected to the end of the suction conduit 60 in the following manner. With one end connected to the outlet 52 of the valve body 51, the suction conduit 60 is extended vertically and looped above the ring-shaped portion **55*b* as shown in FIG. 7 so that the conduit 60 which is extended obliquely downward below the loop is passed through the ring-shaped portion 55*b*. The conduit 60 is then bent upward on the floor surface 58 so as to be connected to the suction port 7** of the motor pump.

The operation of the check valve will next be explained.

In the state wherein the suction conduit 60 is not connected to the suction check valve, the check valve body 51 is gravitationally urged so as to pivot counterclockwise, that is, toward the floor surface 58, about the lower end 59 of that peripheral portion of the bottom plate 56 which lies in the direction opposite to the direction in which the valve body 51 is made eccentric with respect to the bottom plate 56. In an operative state shown in FIG. 7, the greater part of the weight of the suction conduit 60 is loaded on the ring-shaped portion **55*b*, and this loading force (gravitational force) acts on the central portion of the bottom plate 56 as shown by the arrow F through the mounting bolt 55*a*, thus producing counterclockwise torque which urges the bottom plate 56 to pivot toward the floor surface 58 about the pivot point 59. This torque cooperates with the above-described counterclockwise torque produced by the valve body 51 itself to stably support the bottom plate 56 on the floor surface 58. Therefore, the check valve mounted on the bottom plate 56** is stably supported in a normal position at all times during use.

When the motor pump is run in the above-described installation state, liquid (commonly water) on the floor surface 58 is sucked in through the liquid passing openings **62*a* and 63*a* in the ribs 62 and 63 provided on the reverse surface of the bottom plate 56 to enter the inside of the valve body 51 through the suction opening 61 in the bottom plate 56, thus causing the ball-shaped valve member 54 resting on the valve seat 53 to be raised to the two-dot chain line position. The liquid is then sucked into the pump suction port 7 (FIG. 1) through the suction conduit 60**.

When the pump is suspended, the ball-shaped valve member 54 lowers to the solid-line position to rest on the valve seat 53, thus preventing dropping of the pumped water.

This suction check valve provides the following advantages:

(i) The valve body 51 is secured to the bottom plate 56 at a position offset from the center of the plate 56 and the ring-shaped portion **55*b* is formed at the upper end of the mounting bolt 55*a* which is disposed closer to the center of the bottom plate 56. Therefore, when the suction conduit 60 is passed through the ring-shaped portion 55*b* in actual use, the pivot point 59 of the bottom plate 56 and the point of application of the center of gravity are made closer to each other, so that it is possible to stably support both the suction conduit 60 and the bottom plate 56. Accordingly, the suction portion of the check valve mounted on the bottom plate 56** is unlikely to tilt, and it is therefore possible to enable the suction check valve to operate normally at all times.

(ii) By reducing the height of the ribs 62 and 63 provided on the lower (reverse) surface of the bottom plate 56, it is possible to drain the liquid on the floor surface 58 until the liquid level becomes considerably low without the fear of air being sucked in through the gap between the bottom plate 56 and the floor surface 58.

(iii) Since the valve member 54 of the suction check valve is formed in the shape of a ball, it is possible to prevent fibrous foreign matter included in the sucked liquid from coiling around the valve member 54.

Although in the above-described embodiments the pump section is defined by a vortex pump, the present invention is not necessarily limited to the described pump structure. It is, of course, possible to use other types of pumps, for example, a volute pump provided with wear-resistant means. Further, the described structure wherein the bottom of the pump outer casing is defined by a bottom plate which is fastened to the casing by means of through bolts is not necessarily limitative and it is also possible to form the pump outer casing and the bottom plate integral with each other.

The motor pump body may be concentrically disposed inside the pump outer casing.

While the invention has been described in detail with particular reference to illustrative embodiments thereof, it will be understood that variations and modifications can be effected within the spirit and scope of the invention.

What is claimed is:

1. In a portable motor pump of the type in which a pump section driven by a motor is installed inside a liquid chamber, with a discharge port of said pump section being opened into said liquid chamber, and water which is to be pumped is led from the outside of said liquid chamber to a suction port of said pump section and said pump water is discharged from said liquid chamber to the outside, wherein said liquid chamber is defined by a motor pump body, a pump outer casing outwardly spaced from and surrounding said motor pump body, a one piece motor head cover covering an upper opening of said pump outer casing and the top of the motor pump, and a bottom plate covering a lower opening of said pump outer casing, in that a circulating water suction port for self-priming of said motor pump is opened into the liquid chamber, and in that a suction port which communicates with said suction port of said pump section and a discharge port for discharging the pumped water to the outside are provided in said motor head cover, whereby the amount of priming required to effect said self-priming is reduced and residual water having a low level is readily drained.

2. A portable motor pump according to claim 1, wherein said motor pump body is eccentrically disposed inside said pump outer casing.

3. A portable motor pump according to claim 1, wherein said pump section is defined by a vortex pump.

4. A portable motor pump according to claim 1, wherein said self-priming circulating water suction port is provided above the bottom surface of the main plate of an impeller constituting said pump section.

5. A portable motor pump according to claim 1, wherein a water drip hole is provided in said bottom plate and is sealed by a plug.

6. A portable motor pump according to claim 1, wherein said self-priming circulating water suction port is positioned near an area which is diametrically opposite to said discharge port of said pump section in said liquid chamber.

7. A portable motor pump according to claim 1, wherein a nozzle is provided at an outlet of the self-priming circulating water introduced from said self-priming circulating water suction port to cause an ejector action by prime water flow passing through said nozzle and thereby sucking air and water from said suction port of said pump section.

8. A portable motor pump according to claim 1, wherein said pump section includes an impeller shaft having an air lock preventing nut on the distal end thereof.

9. A portable motor pump according to claim 1, wherein a suction check valve having a ball-shaped valve member incorporated in a valve body is connected to said suction port provided in said motor head cover through a suction conduit.

10. A portable motor pump according to claim 9, wherein said suction check valve comprises a valve seat on which said ball-shaped valve member rests, which is defined by a bottom plate of the valve body, and discontinuous projections are provided on the lower surface of said bottom plate, so that a liquid is sucked in through a gap defined by said projections between the lower surface of said bottom plate and the floor surface.

11. A portable motor pump according to claim 10, wherein said bottom plate is made of a resilient material.

12. A portable motor pump according to claim 10, wherein said ball-shaped valve member is made of a resilient material.

13. A portable motor pump according to claim 9, wherein said check valve is secured to a bottom plate at a position offset from the center of said bottom plate by means of mounting bolts; one of said mounting bolts which is closer to the center of said bottom plate is extended upward; and a ring-shaped portion which enables the suction conduit to pass therethrough is formed at the upper end of said upwardly extended mounting bolt.

14. A portable motor pump according to claim 13, wherein said ring-shaped portion is formed by bending the upper end portion of said upwardly extended mounting bolt.

15. A portable motor pump according to claim 13, wherein said bottom plate is placed on the floor surface through a rib having a liquid passing opening.

16. In a portable motor pump of the type in which a pump section driven by a motor is installed inside a liquid chamber, with a discharge port of said pump section being opened into said liquid chamber, and water which is to be pumped is led from the outside of said liquid chamber to a suction port of said pump section and said pumped water is discharged from said liquid chamber to the outside, said portable motor pump is characterized in that said liquid chamber is defined by a motor pump body, a pump outer casing outwardly spaced from and surrounding said motor pump body, a motor head cover covering an upper opening of said pump outer casing, and a bottom plate covering a lower opening of said pump outer casing, in that a circulating water suction port for self-priming of said motor pump is opened into the liquid chamber, in that a suction passage communicating with said suction port of the pump section is defined between an upper surface of said bottom plate and a lower surface of a casing portion of said motor pump body, and in that a nozzle communicating with said circulating water suction port and with said suction passage of said pump section is positioned in said bottom plate.

17. A portable motor pump according to claim 16, wherein said motor pump body is eccentrically disposed inside said pump outer casing.

18. A portable motor pump according to claim 16, wherein said pump section is defined by a vortex pump.

19. A portable motor pump according to claim 16, wherein said self-priming circulating water suction port is provided above the bottom surface of the main plate of an impeller constituting said pump section.

20. A portable motor pump according to claim 16, wherein a water drip hole is provided in said bottom plate and is sealed by a plug.

21. A portable motor pump according to claim 16, wherein said self-priming circulating water suction port is positioned near an area which is diametrically opposite to said discharge port of said pump section in said liquid chamber.

22. A portable motor pump according to claim 16, wherein a nozzle is provided at an outlet of the self-priming circulating water introduced from said self-priming circulating water suction port to cause an ejector action by prime water flow passing through said nozzle and thereby sucking air and water from said suction port of said pump section.

23. A portable motor pump according to claim 16, wherein said pump section includes an impeller shaft having an air lock preventing nut on the distal end thereof.

24. A portable motor pump according to claim 16, wherein a suction check valve having a ball-shaped valve member incorporated in a valve body is connected to said suction port provided in said motor head cover through a suction conduit.

25. A portable motor pump according to claim 24, wherein said suction check valve comprises a valve seat on which said ball-shaped valve member rests, said valve seat being defined by a bottom plate of the valve body, and discontinuous projections are provided on the lower surface of said bottom plate, so that liquid is sucked in through a gap defined by said projections between the lower surface of said bottom plate and the floor surface.

26. A portable motor pump according to claim 25, wherein said bottom plate is made of a resilient material.

27. A portable motor pump according to claim 25, wherein said ball-shaped valve member is made of a resilient material.

28. A portable motor pump according to claim 24, wherein said check valve is secured to a bottom plate at a position offset from the center of said bottom plate by means of mounting bolts; one of said mounting bolts which is closer to the center of said bottom plate is extended upward; and a ring-shaped portion which enables the suction conduit to pass therethrough is formed at the upper end of said upwardly extended mounting bolt.

29. A portable motor pump according to claim 28, wherein said ring-shaped portion is formed by bending the upper end portion of said upwardly extended mounting bolt.

30. A portable motor pump according to claim 28, wherein said bottom plate is placed on the floor surface through a rib having a liquid passing opening.

* * * * *